US007866474B2

(12) United States Patent
Geser et al.

(10) Patent No.: US 7,866,474 B2
(45) Date of Patent: Jan. 11, 2011

(54) FILM CONTAINER

(75) Inventors: Johannes Geser, Ingelheim (DE); Sebastian Beyer, Eltville (DE)

(73) Assignee: Boehringer Ingelheim International GmbH, Ingelheim (DE)

( * ) Notice: Subject to any disclaimer, the term of this patent is extended or adjusted under 35 U.S.C. 154(b) by 623 days.

(21) Appl. No.: 11/305,365

(22) Filed: Dec. 16, 2005

(65) Prior Publication Data

US 2006/0131204 A1 Jun. 22, 2006

(30) Foreign Application Priority Data

Dec. 21, 2004 (DE) ..... 10 2004 062 864

(51) Int. Cl.
*B65D 1/09* (2006.01)

(52) U.S. Cl. ..... 206/532; 206/534.1; 206/528; 206/469; 383/207

(58) Field of Classification Search ..... 206/532, 206/528, 530, 531, 534, 539, 538, 469; 220/359.1, 220/359.2, 359.4; 383/200, 207
See application file for complete search history.

(56) References Cited

U.S. PATENT DOCUMENTS 3,809,220 A * 5/1974 Arcudi ..... 206/484
3,809,221 A 5/1974 Compere
3,811,564 A 5/1974 Braber
3,872,970 A * 3/1975 Edison ..... 206/532
3,921,805 A * 11/1975 Compere ..... 206/532
3,924,746 A 12/1975 Haines
3,941,248 A 3/1976 Moser et al.
4,243,144 A 1/1981 Margulies
4,398,634 A * 8/1983 McClosky ..... 206/532
4,612,755 A 9/1986 Cavanagh
4,673,086 A 6/1987 Braverman et al.
4,803,868 A 2/1989 Vinton et al.
4,838,425 A 6/1989 O'Brien et al.
4,876,843 A 10/1989 O'Brien et al.
4,911,304 A 3/1990 Bunin
5,014,851 A 5/1991 Wick
5,046,618 A 9/1991 Wood
5,088,603 A * 2/1992 Kirkpatrick ..... 206/530

(Continued)

FOREIGN PATENT DOCUMENTS

DE 197 51 428 A1 5/1998

(Continued)

OTHER PUBLICATIONS

English Abstract: DE 20 2004 003 782.

(Continued)

*Primary Examiner*—David T Fidei
(74) *Attorney, Agent, or Firm*—Michael P. Morris; Wendy A. Petka

(57) ABSTRACT

A film container (FIG. 4) comprises two rectangular films (5) joined together at their periphery to form a receiving chamber (6) for a filling (7), particularly a pharmaceutical formulation of an active substance, at least one of said films (5) being provided, for the purpose of tearing it open, with a marking (13) formed within the connecting region, which is exposed after the films (5) have been bent. The marking (13) extends centrally between two opposing outer edges (11) of the film container (1).

41 Claims, 2 Drawing Sheets

U.S. PATENT DOCUMENTS 5,172,812 A 12/1992 Wharton et al.
5,310,060 A 5/1994 Bitner et al.
5,325,968 A 7/1994 Sowden
5,358,118 A 10/1994 Thompson et al.
5,360,116 A 11/1994 Schmiletzky
5,450,710 A 9/1995 Jensen et al.
5,469,968 A 11/1995 Matthews et al.
5,472,093 A 12/1995 Nugent et al.
5,511,665 A 4/1996 Dressel et al.
5,542,235 A 8/1996 Konstandin
5,542,236 A 8/1996 Miller et al.
5,551,567 A 9/1996 Malone et al.
5,737,902 A 4/1998 Aylward
5,740,717 A 4/1998 Sowden et al.
5,758,774 A 6/1998 Leblong
5,775,505 A 7/1998 Vasquez et al.
5,791,478 A 8/1998 Kalvelage et al.
5,862,915 A * 1/1999 Plezia et al. ..... 206/528
5,879,612 A 3/1999 Zeiter et al.
5,927,500 A 7/1999 Godfrey et al.
5,938,032 A 8/1999 Svec et al.
5,944,191 A 8/1999 Ray et al.
5,954,204 A 9/1999 Grabowski
6,036,016 A 3/2000 Arnold
6,055,794 A 5/2000 Breitler
6,085,942 A * 7/2000 Redmond ..... 222/107
6,135,755 A 10/2000 Zeiter et al.
6,155,423 A 12/2000 Katzner et al.
6,199,698 B1 3/2001 Hetrick et al.
6,212,858 B1 4/2001 Breitler
6,219,997 B1 4/2001 Friberg et al.
6,230,894 B1 5/2001 Danville
6,244,442 B1 6/2001 Inoue et al.
6,253,920 B1 7/2001 Kaellgren
6,269,671 B1 8/2001 Zeiter et al.
6,338,407 B2 1/2002 Danville
6,352,158 B1 3/2002 Cole-Bennett et al.
6,375,956 B1 4/2002 Hermelin et al.
6,422,391 B1 7/2002 Swartz
6,430,984 B2 8/2002 Zeiter et al.
6,470,650 B1 10/2002 Lohwasser
6,516,949 B2 2/2003 Fuller et al.
6,568,533 B1 5/2003 Tanaka et al.
6,598,745 B2 7/2003 Bolnick et al.
6,659,280 B2 12/2003 Paliotta et al.
6,679,031 B2 1/2004 Tampieri
6,705,467 B1 3/2004 Kancsar et al.
6,776,285 B2 8/2004 Shibata
6,793,077 B1 9/2004 Kancsar et al.
6,802,422 B2 10/2004 Kalvelage et al.
6,830,153 B2 12/2004 French et al.
6,851,874 B2 2/2005 Gonzalez et al.
2001/0009231 A1 7/2001 Danville
2002/0008046 A1 1/2002 Fuller et al.
2002/0045184 A1 4/2002 Chen
2002/0104773 A1 8/2002 Kalvelage et al.
2002/0162768 A1 11/2002 Bolnick et al.
2002/0166790 A1 11/2002 Aylward
2003/0102247 A1 6/2003 Inoue et al.
2003/0111379 A1 6/2003 Intini
2003/0111380 A1 6/2003 Taneja et al.
2003/0181488 A1 9/2003 Brauns
2003/0209460 A1 11/2003 Bolnick et al.
2003/0209461 A1 11/2003 French et al.
2004/0026293 A1 2/2004 Hughes
2004/0069675 A1 4/2004 Stevens
2004/0093835 A1 5/2004 Siegel et al.
2004/0134826 A1 7/2004 Winberg
2004/0140242 A1 7/2004 Davies
2004/0182738 A1 9/2004 Williams-Hartman
2004/0182739 A1 9/2004 Williams-Hartman
2004/0222122 A1 11/2004 Intini
2005/0023180 A1 2/2005 Intini
2005/0051453 A1* 3/2005 Schuler et al. ..... 206/528
2005/0061705 A1 3/2005 Spallek et al.
2005/0077202 A1 4/2005 Blum et al.
2005/0087472 A1 4/2005 Elliott
2005/0087474 A1 4/2005 Killinger
2005/0103677 A1 5/2005 Fuchsberger
2005/0103678 A1 5/2005 Clark et al.
2005/0181182 A1 8/2005 Heath
2005/0205457 A1 9/2005 Iossi

FOREIGN PATENT DOCUMENTS

DE 202 14 671 1/2003
DE 20 2004 003 782 U1 8/2004
EP 0 771 737 A1 5/1997
WO WO 00/24647 A1 5/1998
WO WO 03/066472 A1 8/2003
WO WO 03/074056 A1 9/2003

OTHER PUBLICATIONS

English Abstract: DE 197 51 428.
Englsih Abstract: DE 202 14 671.

* cited by examiner

FILM CONTAINER

RELATED APPLICATIONS

This application claims priority to German Application No. 10 2004 062 864.5, filed Dec. 21, 2004, which is hereby incorporated by reference in its entirety.

FIELD OF THE INVENTION

The invention relates to a film container having two, in particular, rectangular films joined together around their periphery to form a receiving chamber for a filling, particularly a pharmaceutical formulation of an active substance, at least one of the films being provided, for the purpose of tearing it open, with a marking formed within the connecting region, which is exposed when the films are bent over.

The film containers are used, among other things, to protect pharmaceutical formulations of active substances from environmental influences from the outside which might in some cases degrade the pharmaceutical quality of the formulation.

In some countries, regulations for childproof packaging of medical products are being considered or are already in existence in order to make it difficult for children to access, in particular, medicaments which have a toxic effect or which present a relatively serious health risk when used inappropriately.

For example, DE 20 2004 003 781 U1 discloses a childproof rectangular package consisting of two films of foils joined together, the flat connecting area of which encloses at least one receiving chamber for a filling. In order to open the film container, a physical marking in the form of a modification, particularly a weakened area or the removal of a section of the edge, is provided, which is totally surrounded by the closure region. The first marking provided is a cut or a line in the closure region of the packaging formed from the films, this closure region being in the form of a sealed edge portion, this first marking not extending as far as the edge of the packaging, while the second marking provided is a line which intersects the first marking and which when creased exposes the first marking towards the outer contour for the purpose of tearing. The closure region is broadened out, in the region of an unsealed removal portion, to form a tab which is creased so that the cut becomes part of the outer contour. The package is opened by tearing off one end of the packaging at the location of the cut. Moreover, a rectangular bag is shown having a sealed edge which is broadened out in a corner region, while extending through this is a bending line extending diagonally of the outer contour, and from this there proceeds, at right angles, a cut or a perforated section for tearing open the packaging.

The problem of the invention is to provide a film container of the type described above which is sealed so as to be childproof while opening over a large area and at the same time being easy to manufacture.

SUMMARY OF THE INVENTION

According to the invention this problem is solved in that the marking extends centrally between two opposing outer edges of the film container.

The film container according to the invention has no additional tab or connecting area which is modified in relation to the receiving chamber, as in the prior art constructions, and for this reason it is relatively easy and therefore inexpensive to produce. After the deliberate folding or creasing of the films, in accordance with the instructions on an information sheet, for example, the film container is torn open centrally along the marking in order to remove a primary package, a powder, a liquid or other filling, while the marking, e.g., a partial weakening of the films, ensures at least that the films are torn open by a tearing action into the receiving chamber and after creasing is present at least at the outer edge of the film container.

To make the creasing of the films easier in order to expose the marking, another marking is expediently provided for controlled creasing of the films parallel to and at a spacing from an outer edge of the film container. The further marking may, for example, extend over the full width of the film container and be printed as a line on one of the films. In order to protect the filling, the distance of the further marking from the associated outer edge is less than the distance from the receiving chamber.

Preferably, the further marking divides the marking asymmetrically. In other words, the marking is of a different length on one side of the further marking from the other side. Preferably the length of the marking between the receiving chamber and the further marking is longer than between the further marking and the corresponding outer edge. Thus, on the one hand, it is relatively easy to tear open the films in order to remove the filling and on the other hand the filling is protected from environmental influences by a relatively large-area connecting region. In order to make it easier to remove the filling, the marking advantageously extends centrally with respect to the receiving chamber. Expediently, the marking and the further marking run at right angles to one another.

In a second preferred embodiment the further marking divides the marking symmetrically, i.e., the marking has the same length on both sides of the further marking. This variant is particularly preferred when reasons of tolerance argue against the asymmetric shape, particularly in connection with a marking which is short in length, e.g., 1 mm. In this embodiment, too, the tearing of the films in order to remove the filling is relatively easy to carry out, on the one hand, and, on the other hand, the filling is protected from environmental influences on account of a relatively large-area connecting region. In order to make it easier to remove the filling, the marking advantageously extends centrally with respect to the receiving chamber. Expediently, the marking and the further marking run at right angles to one another.

According to one feature, the marking is in the form of a notch or cut. Preferably the further marking is a perforation. Thanks to these measures, the film container can be opened without the use of tools and the processes needed to open it can be grasped intuitively by an adult.

In order to protect the filling from moisture penetrating through the connecting region, the two films are joined together by a heat-sealing lacquer.

Expediently, one film is constructed as the carrier film bearing the receiving chamber and the other film is constructed as the cover film. The carrier film of the so-called blister is formed by thermoforming, for example. Preferably, the films are constructed as metal and/or plastics and/or paper films. These materials may be present in several layers. The carrier film consists, for example, on the side facing the filling, of an approximately 60 μm thick layer of polyvinylchloride (PVC) followed by an approximately 45 μm thick aluminum foil which is in turn attached to an approximately 25 μm thick film of an oriented polyamide (oPA). The cover film may for example consist, on the side facing the filling, of an approximately 5 μm (3 to 7 μm) thick layer of heat sealing lacquer, for example, a commercially obtainable acrylate-based polymer mixture, an approximately 20 μm thick aluminum film and connected thereto an approximately 23 μm thick film of a polyethyleneterephthalate (PET). Naturally, the two films may also be identical or made from other materials, while PET and a PVC/aluminum laminate per se being difficult to tear.

Aluminum foil also has the advantage that it protects light- or UV-sensitive filling from visible light and UV radiation.

According to a further feature, a plurality of film containers are combined to form a blister card and can be separated by means of intersecting perforations. A blister card may, for example, comprise six film containers, each film container being separated from adjacent film containers by means of the intersecting perforations.

To make it more difficult for a child to open a film container in the blister card as a whole, the further marking preferably runs parallel to and at a spacing from a perforation which divides the blister card along its center. Accordingly, it is necessary either to separate a film container from the blister card first of all, with subsequent creasing along the further marking in order to tear it open along the marking or, optionally after separating the blister card into two halves, to crease all the film containers on one side of the perforation which divides the blister card and then to tear a foil container open along this marking, in which case it is substantially more difficult to tear through the uninterrupted edge configuration of the opposite film container.

It would be understood that the features mentioned above and those which will be described in more detail hereinafter may be used not only in the combination specified but also in other combinations. The scope of the invention is defined solely by the claims.

The film container according to the invention is suitable, for example, for packaging pharmaceutical formulation containing dabigatran etexilate, as described, for example, in WO 03/074056, corresponding to U.S. Patent Application Publication No. 2003/0181488, each of which is incorporated by reference herein.

BRIEF DESCRIPTION OF THE DRAWINGS

The invention is hereinafter described in more detail by means of an exemplifying embodiment with reference to the associated drawings, wherein.

DETAILED DESCRIPTION OF THE INVENTION

Figure 1:
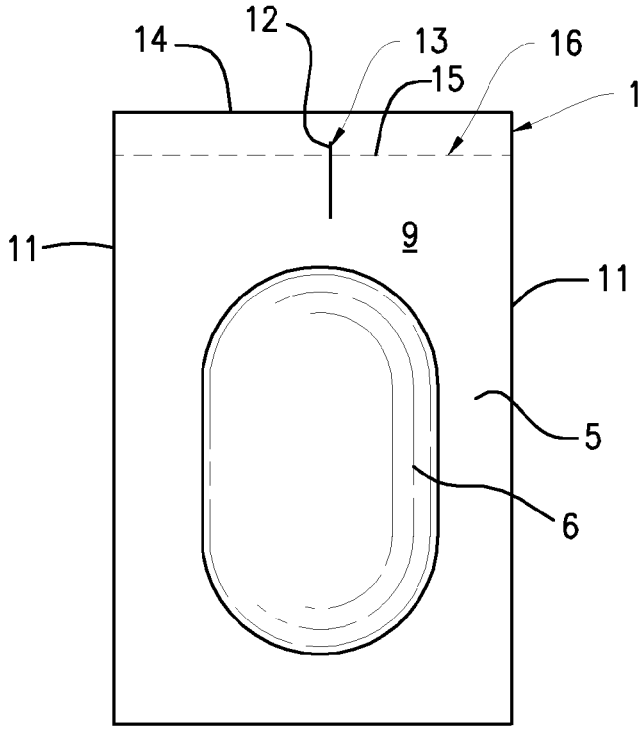
FIG. 1 is a plan view of a film container according to the invention.
Figure 2:
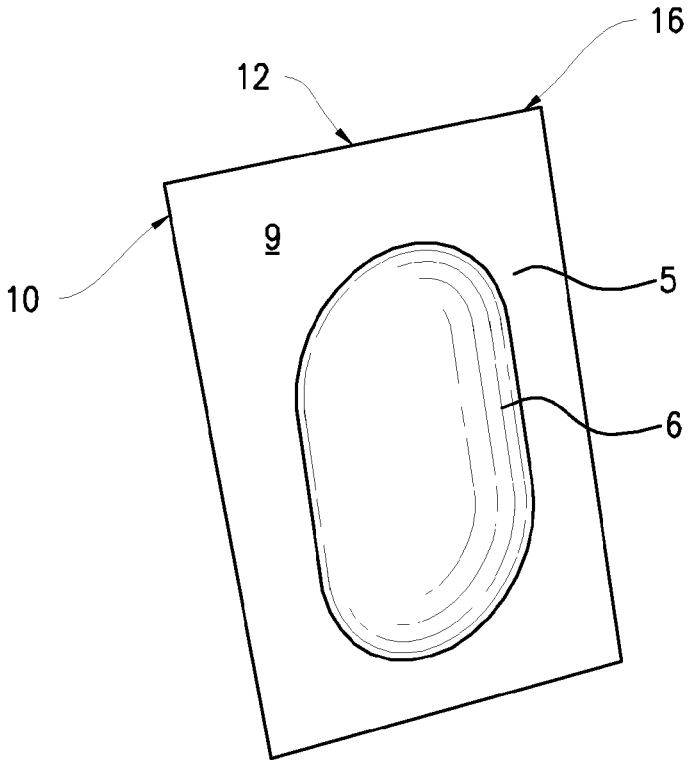
FIG. 2 is a perspective view of the film container according to FIG. 1.
Figure 3:
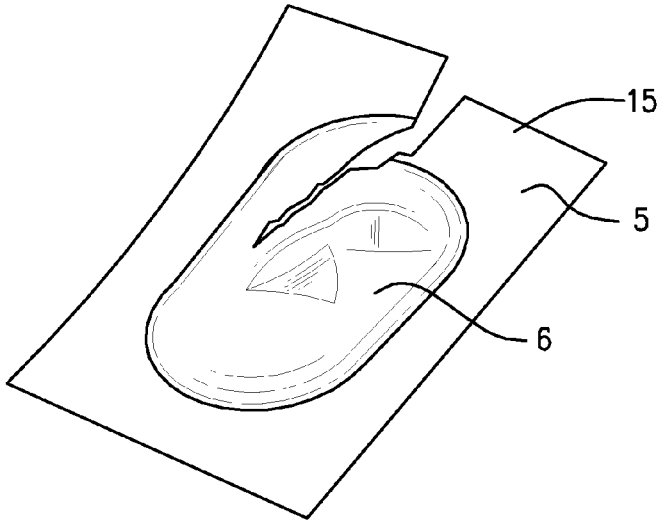
FIG. 3 is another perspective view of the film container according to FIG. 1.
Figure 4:
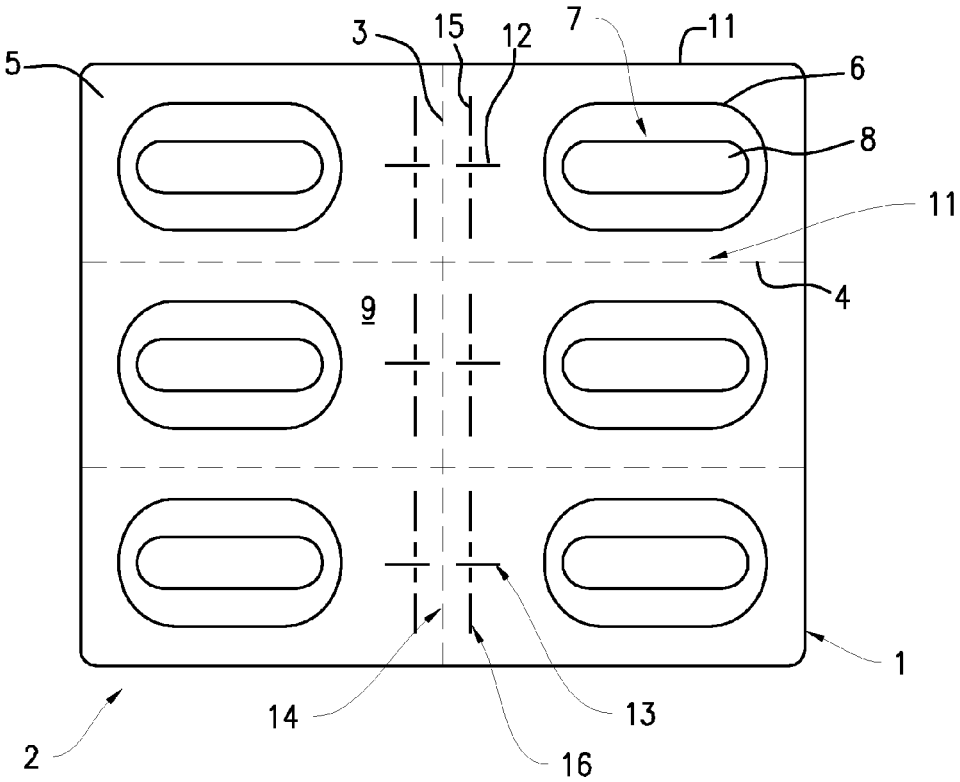
FIG. 4 is a diagrammatic view of a blister card made up of a plurality of film containers according to FIG. 1.

The film container 1 in the form of a blister is part of a blister card 2 provided with intersecting perforations 3, 4 for separating the film containers 1. Each of the film containers essentially comprises two films 5, one of which is constructed as a carrier film 9 comprising a receiving chamber 6 for a filling 7, namely a capsule 8 filled with a pharmaceutical active substance, while the other is constructed as a cover film 10 attached to the carrier film 9 by means of a heat sealing lacquer, the connecting region between the two films 5 extending over the entire surface thereof, apart from the receiving chamber 6.

Between two parallel longitudinal outer edges 11 of the rectangular film container 1 is provided, centrally with respect to the receiving chamber 6, in the connecting region of the two films 5, a marking 13 in the form of a cut 12 which is spaced from both the associated outer edge 14 at the end face and from the receiving chamber 6. The cut 12 acts as an aid to tearing and after the film container 1 has been creased, is present along a further marking 16 on the corresponding outer edge 14, in the form of a perforation 15, extending parallel to and at a spacing from the corresponding outer edge 14 at the end face. The further marking 16 extending over the entire width of the film container 1 runs at right angles to the cut 12 and divides it asymmetrically so that the path of the cut 12 between the receiving chamber 6 and the further marking 16 is longer than the part between the further marking 16 and the adjacent outer edge 14 at the end face. The outer edge 14 associated with the further marking 16 opens into the centrally extending perforation 3 in the blister card 2, and this is why the film container 1 can only be torn open to remove the capsule 8 after it has been separated off.

We claim:

1. A blister card comprising:

a plurality of combined film containers, the containers operatively separated by intersecting perforations, each of the plurality of film containers comprising:

two rectangular films joined together at their periphery to form a receiving chamber containing a pharmaceutical formulation of an active substance, at least one of the films being provided, for the purpose of tearing the at least one of the films open into and through the receiving chamber, with: (i) a cut formed within a connecting region, which cut, after the films have been bent, operates to tear into and through the at least one of the films of the receiving chamber such that an inner volume of the receiving chamber is exposed, wherein the cut extends centrally between two opposing outer edges of the film container; and (ii) an additional perforation for the controlled bending of the films provided parallel to, and at a spacing from, an associated outer edge of the film container, such that the cut is longer between the receiving chamber and the additional perforation than between the additional perforation and the associated outer edge.

2. The blister card according to claim 1, wherein the spacing of the additional perforation from the associated outer edge is less than a spacing from the receiving chamber.

3. The blister card according to claim 1, wherein the additional perforation divides the cut asymmetrically.

4. The blister card according to claim 2, wherein the additional perforation divides the cut asymmetrically.

5. The blister card according to claim 1, wherein a path of the cut between the receiving chamber and the additional perforation is longer than between the additional perforation and the associated outer edge.

6. The blister card according to claim 2, wherein a path of the cut between the receiving chamber and the additional perforation is longer than between the additional perforation and the associated outer edge.

7. The blister card according to claim 3, wherein a path of the cut between the receiving chamber and the additional perforation is longer than between the additional perforation and the associated outer edge.

8. The blister card according to claim 4, wherein a path of the cut between the receiving chamber and the additional perforation is longer than between the additional perforation and the associated outer edge.

9. The blister card according to claim 1, wherein the additional perforation divides the cut symmetrically.

10. The blister card according to claim 2, wherein the additional perforation divides the cut symmetrically.

11. The blister card according to claim 1, wherein the cut extends centrally with respect to the receiving chamber.

12. The blister card according to claim 2, wherein the cut extends centrally with respect to the receiving chamber.

13. The blister card according to claim 3, wherein the cut extends centrally with respect to the receiving chamber.

14. The blister card according to claim 9, wherein the cut extends centrally with respect to the receiving chamber.

15. The blister card according to claim 1, wherein the cut and the additional perforation extend at right angles to each other.

16. The blister card according to claim 2, wherein the cut and the additional perforation extend at right angles to each other.

17. The blister card according to claim 3, wherein the cut and the additional perforation extend at right angles to each other.

18. The blister card according to claim 9, wherein the cut and the additional perforation extend at right angles to each other.

19. The blister card according to claim 11, wherein the cut and the additional perforation extend at right angles to each other.

20. The blister card according to claim 1, wherein the cut is in the form of a notch.

21. The blister card according to claim 1, wherein the two films include a heat sealing lacquer for joining the two films together.

22. The blister card according to claim 1, wherein one film is constructed as a carrier film comprising the receiving chamber and the other film is constructed as a covering film.

23. The blister card according to claim 1, wherein the films are constructed as metal and/or plastics and/or paper films.

24. The blister card according to claim 1, wherein the additional perforation extends parallel to and at a spacing from a perforation which divides the blister card in its center.

25. The blister card according to claim 1, wherein the filling is a pharmaceutical formulation comprising dabigatran etexilate.

26. The blister card according to claim 3, wherein the filling is a pharmaceutical formulation comprising dabigatran etexilate.

27. The blister card according to claim 1, wherein the filling is a pharmaceutical formulation comprising dabigatran etexilate.

28. The blister card according to claim 5, wherein the filling is a pharmaceutical formulation comprising dabigatran etexilate.

29. A blister card comprising:

a plurality of combined film containers, the containers operatively separated by intersecting perforations, each of the plurality of film containers comprising two rectangular films joined together at their periphery to form a receiving chamber containing a pharmaceutical formulation of an active substance, at least one of the films being provided, for the purpose of tearing the at least one of the films open into and through the receiving chamber, with: (i) a cut formed within a connecting region, which cut, only after the films have been bent, operates to tear into and through the at least one of the films of the receiving chamber such that an inner volume of the receiving chamber is exposed, wherein the cut extends centrally between two opposing outer edges of the film container; and (ii) an additional perforation for the controlled bending of the films provided parallel to, and at a spacing from, an associated outer edge of the film container, wherein the additional perforation divides the cut asymmetrically such that the cut has a greater length between the receiving chamber and the additional perforation than between the additional perforation and the associated outer edge.

30. The blister card according to claim 29, wherein the spacing of the additional perforation from the associated outer edge is less than a spacing from the receiving chamber.

31. The blister card according to claim 29, wherein the additional perforation divides the cut asymmetrically.

32. The blister card according to claim 29, wherein a path of the cut between the receiving chamber and the additional perforation is longer than between the additional perforation and the associated outer edge.

33. The blister card according to claim 29, wherein the cut extends centrally with respect to the receiving chamber.

34. The blister card according to claim 33, wherein the additional perforation divides the cut symmetrically.

35. The blister card according to claim 33, wherein the cut and the additional perforation extend at right angles to each other.

36. The blister card according to claim 29, wherein the cut is in the form of a notch.

37. The blister card according to claim 29, wherein the two films include a heat sealing lacquer for joining the two films together.

38. The blister card according to claim 29, wherein one film is constructed as a carrier film comprising the receiving chamber and the other film is constructed as a covering film.

39. The blister card according to claim 29, wherein the films are constructed as metal and/or plastics and/or paper films.

40. The blister card according to claim 29, wherein the additional perforation extends parallel to and at a spacing from a perforation which divides the blister card in its center.

41. The blister card according to claim 29, wherein the filling is a pharmaceutical formulation comprising dabigatran etexilate.

* * * * *